US010607743B2

(12) United States Patent
Vose et al.

(10) Patent No.: US 10,607,743 B2
(45) Date of Patent: Mar. 31, 2020

(54) LOW DENSITY SPHERICAL IRIDIUM SOURCE

(71) Applicant: QSA Global Inc., Burlington, MA (US)

(72) Inventors: Mark W. Vose, Windham, NH (US); Mark G. Shilton, Chelmsford, MA (US); Robert Brosofsky, Chelmsford, MA (US)

(73) Assignee: QSA GLOBAL, INC., Burlington, MA (US)

( * ) Notice: Subject to any disclaimer, the term of this patent is extended or adjusted under 35 U.S.C. 154(b) by 0 days.

(21) Appl. No.: 16/302,221

(22) PCT Filed: May 19, 2017

(86) PCT No.: PCT/US2017/033508

§ 371 (c)(1),
(2) Date: Nov. 16, 2018

(87) PCT Pub. No.: WO2017/205202

PCT Pub. Date: Nov. 30, 2017

(65) Prior Publication Data

US 2019/0295736 A1 Sep. 26, 2019

Related U.S. Application Data

(60) Provisional application No. 62/340,777, filed on May 24, 2016, provisional application No. 62/378,881, filed on Aug. 24, 2016.

(51) Int. Cl.
*G21G 4/06* (2006.01)

(52) U.S. Cl.
CPC ..... *G21G 4/06* (2013.01)

(58) Field of Classification Search
CPC ..... G21G 4/06
USPC ..... 250/493.1
See application file for complete search history.

(56) References Cited

U.S. PATENT DOCUMENTS

| | | | | |
|---|---|---|---|---|
| 2,394,727 | A | 2/1946 | Taylor | |
| 6,099,458 | A * | 8/2000 | Robertson | A61N 5/1027 600/3 |
| 7,118,729 | B1 | 10/2006 | O'Foghludha | |
| 2003/0149329 | A1 | 8/2003 | O'Foghludha | |
| 2013/0291788 | A1* | 11/2013 | Houzvicka | C30B 29/28 117/15 |
| 2015/0102238 | A1 | 4/2015 | Finger et al. | |

(Continued)

FOREIGN PATENT DOCUMENTS

| | | |
|---|---|---|
| DE | 19824689 | 10/1999 |
| WO | 2004109716 | 12/2004 |

(Continued)

OTHER PUBLICATIONS

Notification Concerning Transmittal of International Preliminary Report on Patentability issued in Application No. PCT/US2017/033508 dated Dec. 6, 2018.

(Continued)

*Primary Examiner* — Nicole M Ippolito
(74) *Attorney, Agent, or Firm* — McCarter & English, LLP

(57) ABSTRACT

The disclosure pertains to a radiation source, typically containing low-density microbeads of iridium or compounds thereof within an encapsulation, and methods of manufacture thereof.

25 Claims, 11 Drawing Sheets

(56) References Cited

U.S. PATENT DOCUMENTS

2017/0084357 A1* 3/2017 Shilton ..... G21G 4/06

FOREIGN PATENT DOCUMENTS

| | | |
|---|---|---|
| WO | 2015105539 | 7/2015 |
| WO | 2015/175326 | 11/2015 |

OTHER PUBLICATIONS http://www.orau.org/ptp/collection/sources/3mdisk.htm.
http://www.nrc.gov/docs/ML0415/ML041550720.
International Search Report issued in PCT/US2017/033508 dated Sep. 19, 2017.
International Search Report issued in PCT/US2019/037697 dated Sep. 26, 2019.
V. Raghavan, "Al-B-Ir (Aluminum-Boron-Iridum)", Journal of Phase Equilibria and Diffusion, vol. 29, No. 1, 2008, p. 42.
V. Raghavan, "Al-Ir-V (Aluminum-Iridium-Vanadium)", Journal of Phase Equilibria and Diffusion, vol. 29, No. 4, 2008, p. 372.
H. Ipser and P. Rogl, "Constitution Diagrams of the Binary Systems Pd-B and Ir-B", Elsevier Sequoia/Printed in The Netherlands, Metall. Trans. A., 1981, p. 363.
G. B. Ulrich, "The Metallurgical Integrity of the Frit Vent Assembly Diffusion Bond", Process Metallurgy Department Development Organization, Jun. 1994, pp. 1-22.
Himikatus.Ru, http://www.himikatus.ru/art/phase-diagr1/Al-Ir.php, pp. 1-5.

* cited by examiner

10 – 20 stackable cassettes to fit inside an irradiation target assembly

3620 – 7240 beads

LOW DENSITY SPHERICAL IRIDIUM SOURCE

This application is a National Phase application of PCT/US2017/033508 filed May 19, 2017 which claims priority under 35 U.S.C. § 119(e) of U.S. provisional application Ser. No. 62/378,881 filed on Aug. 24, 2016, and U.S. provisional application Ser. No. 62/340,777, filed on May 24, 2016, the contents of which are hereby incorporated by reference in their entirety and for all purposes.

BACKGROUND OF THE DISCLOSURE

Field of the Disclosure

The disclosure pertains to a gamma radiation source, typically containing microbeads of iridium, or low-density alloys or compounds or composites of iridium, within an encapsulation, and methods of manufacture thereof.

Description of the Prior Art

The prior art of radiation sources of various types for medical, industrial and other processes is well-developed. However, further improvements are sought, particularly with respect to manufacturing economies and product performance.

A prior art method for producing a gamma ray source is disclosed in PCT/NL2004/000401 (also published as WO 2004109716 A2) to Bakker Klass. This method includes the steps of neutron irradiation of disks of iridium or cobalt, and stacking the disks to form a cylinder. Similarly, the prior art includes PCT/US2015/029806 (also published as WO 2015175326 A1) entitled "Device and Method for Enhanced Iridum Gamma Radiation Sources"; German Patent Document DE 19824689 C1 with a translated title "Iridium-Containing Molding Useful as a Gamma Radiation Source e.g., For Weld Seam Radiography and Cancer Treatment"; and PCT/US2015/029806 entitled "Device and Method for Enhanced Iridium Gamma Radiation Sources."

Further prior art relating to the manufacture of metallic spheres includes U.S. Pat. No. 2,394,727 entitled "Method for Making Small Metallic Spheres", issued on Feb. 12, 1946 to Taylor, and information found at:

http://www.orau.org/ptp/collection/sources/3mdisk.htm; and http://www.nrc.gov/docs/ML0415/ML041550720.pdf.

OBJECTS AND SUMMARY OF THE DISCLOSURE

It is therefore an object of the present disclosure to provide improvements in the radioactive sources used in medical and industrial applications. Embodiments of the disclosure may achieve many of the following objectives with respect to the prior art—reduced fabrication costs, reduced focal dimensions (particularly with respect to cylindrical geometry natural iridium disk sources), increased activation yield, increased output (more output Ci/mg due to reduced density), a softer emission spectrum due to low reduced density (i.e., more predominant lower energy emissions) and a near spherical, or quasi-spherical geometry (resulting in improved image quality), but typically including flat sides around its circumference in order to avoid infinitely sharp tangential lid components. Additionally, powder handling can be reduced or eliminated in embodiments of this disclosure.

It is envisioned that embodiments of the present disclosure could increase Iridium-192 output efficiency, perhaps in the range of 11-17 percent, particularly if sources could be made using 50 to 65 percent dense iridium with spherical geometry. This could further result in a reduction of 11 to 17 percent in Iridium-192 source content and annual consumption. Additionally, the softer output spectrum combined with near-spherical focal dimension could result in image quality approaching that of enriched Iridium-192 sources. It is further envisioned that this could potentially lead to an increased activation yield of 7-11 percent and as much as an overall 18-28 percent efficiency gain.

Optionally, if low-density iridium compound/alloy/composite disks containing Iridium-192 could be formed into spheres or quasi-spheres after activation to make spherical or quasi-spherical low density Iridium-192 sources, this concept could achieve similar yield and output gains that have been achieved with annular iridium, but without image quality or focal dimension disadvantages of annuli stacked in a cylindrical configuration.

Alternately, spherical or quasi-spherical low density Iridium-192 sources could also be made using random-packed (or partly random) microgranules of iridium in a spherical or quasi-spherical source cavity. This optimizes the yield and output benefits.

The focal dimension of the spherical or quasi-spherical low density Iridium-192 would typically be no larger than the diagonal of a conventional stacked-disk cylindrical source geometry.

The resulting sources would emit lower energy gamma rays leading to improved image contrast and resolution.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
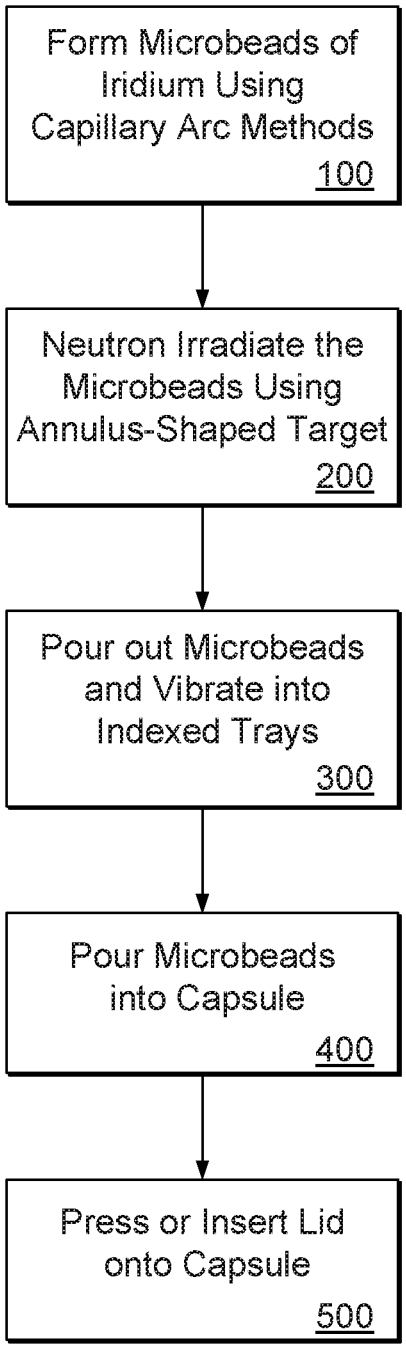
FIG. 1 is a flowchart of a typical embodiment of the manufacturing process of the present disclosure, with variations being envisioned.

Referring now to the drawings in detail, one sees that FIG. 1 illustrates the various steps of the manufacturing process. In step 100, microbeads of iridium are formed by capillary arc or similar methods or by melting iridium powder or cut wire pieces in graphite molds using a high temperature furnace with vacuum or inert gas atmosphere. Possible materials include pure iridium or iridium compounds, alloys or composites such as iridium-boron (where preferably, the boron has been substantially depleted in the highly neutron-absorbing isotope Boron-10), iridium-aluminum, iridium-boron-aluminum and any other low-activating additives that may optimize material properties to aid manufacturability while lowering the bulk density.

Step 200 is using an annulus-shaped target to neutron irradiate the microbeads of iridium or iridium compounds, alloys or composites. Typically, this is done with a view to activating naturally-occurring stable Iridium (which contains ~37.3% Ir-191 and ~62.7% Ir-193) into Iridium-192, which can be used as a gamma radiation source in various medical, brachytherapeutic or industrial processes. Other geometries are envisioned, including a regular cylinder where microbeads are distributed fairly evenly throughout the volume.

Similarly, while it is envisioned that the microbeads are typically spherical or quasi-spherical, they may be replaced with similar cylindrical shapes (such as microcylinders which would be formed by cutting short segments from a cylindrical wire) or ellipsoids (such as rotating an ellipse around its minor axis forming a discus-type shape or rotating an ellipse around its major axis thereby forming a cigar or dirigible-type shape). In particular, an ellipsoid in a discus-type shape may have a particularly high practical packing density. Further, in the case of microcylinders, a typical length and diameter could be 0.3 millimeters (optimally 0.2-0.5 mm., although other similar dimensions could be used) and the activation by neutron irradiation may occur to a longer wire segment, prior to cutting into microcylinder segments.

In step 300, the irradiated microbeads (containing Iridium-192) are poured out and may be vibrated (or otherwise poured and tipped, or similarly handled) into indexed trays. In some embodiments, clusters of microbeads may flow freely into a micro-hopper for activity measurement (and/or physical weighing and/or optical bead counting) before being transferred into a source capsule for welding.

Figure 7:
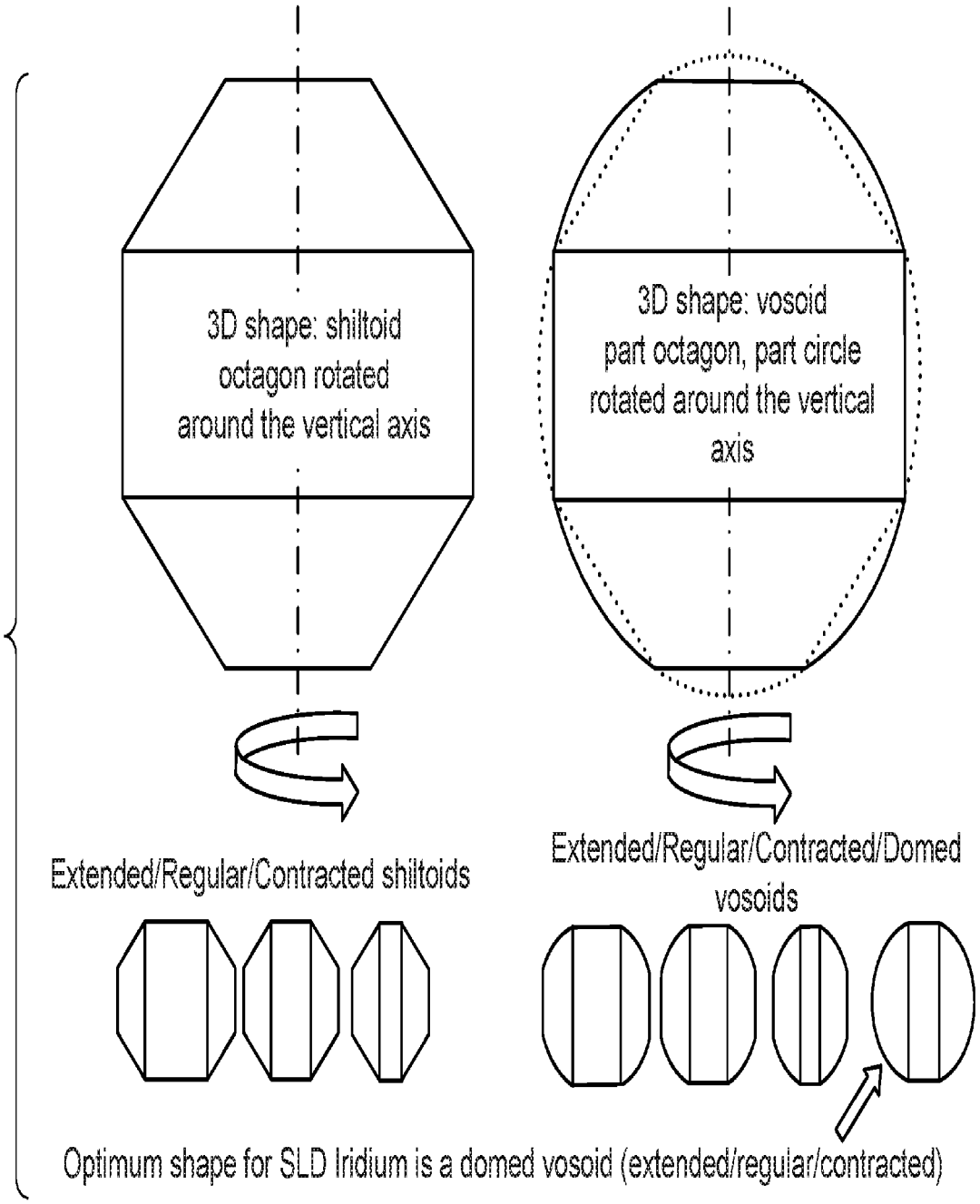
FIG. 7 illustrates the shiltoid and vosoid solid shapes which may be used for the capsule in embodiments of the present disclosure.

In step 400, the microbeads are poured, typically by weight or by measured activity content, into a capsule, such as, but not limited to, a capsule with a vosoid-shaped inner cavity. As illustrated in FIG. 7, a vosoid (a term coined by the applicants) is formed by inscribing an octagon within a circle, retaining the alternating octagonal walls which form the top, bottom and vertical sides while retaining the circular portions for the remaining portions, and then rotating the resulting shape about its vertical axis. Likewise, a shiltoid (a term coined by the applicants), formed by rotating an octagon about its vertical axis, may be a suitable construction for the capsule this embodiment.

In step 500, a lid is pressed onto the vosoid (or similar) capsule. The resulting spherical or quasi-spherical iridium radiation source typically has a reduced density with respect to the prior art. Typical random (or partly random) packing density of microbeads in a void typically lies in the range 48-64% depending on the size and shape distribution of the microbeads, the packing pressure and wall-effects (the region next to the cavity wall where packing is not random and is generally lower than the average density within the center of the void). The process for manufacturing the spherical or quasi-spherical iridium radiation source further typically has reduced or eliminated powder handling and thermochemical processing to produce disks as compared to the prior art.

Figure 2:
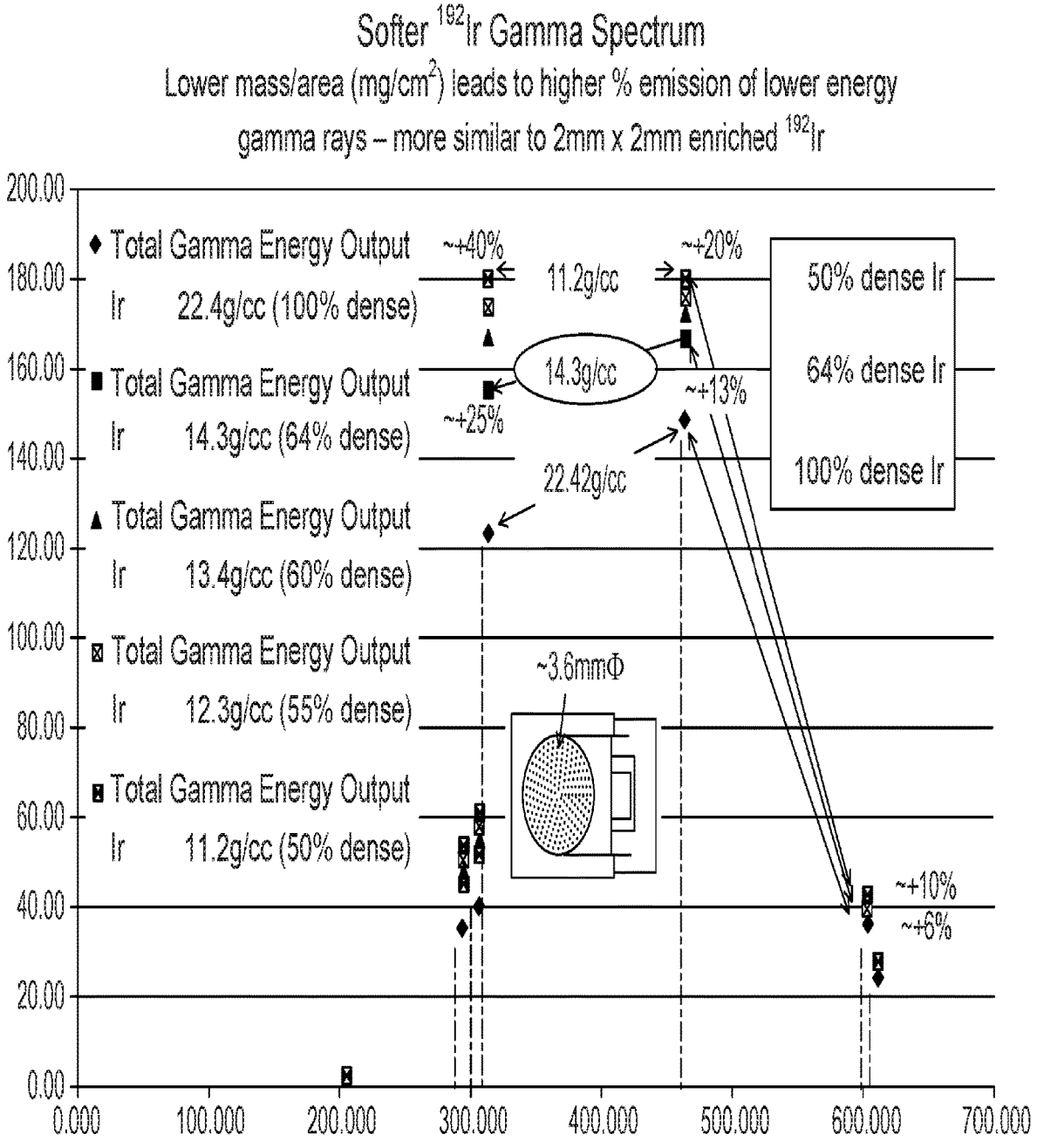
FIG. 2 illustrates calculated gamma energy spectral abundances as a function of iridium density in accordance with an embodiment of the present disclosure.

Referring to FIG. 2, one sees a typical gamma energy spectrum showing calculated spectral abundances as a function of iridium density for lower density iridium in accordance with the above process.

Figure 3:
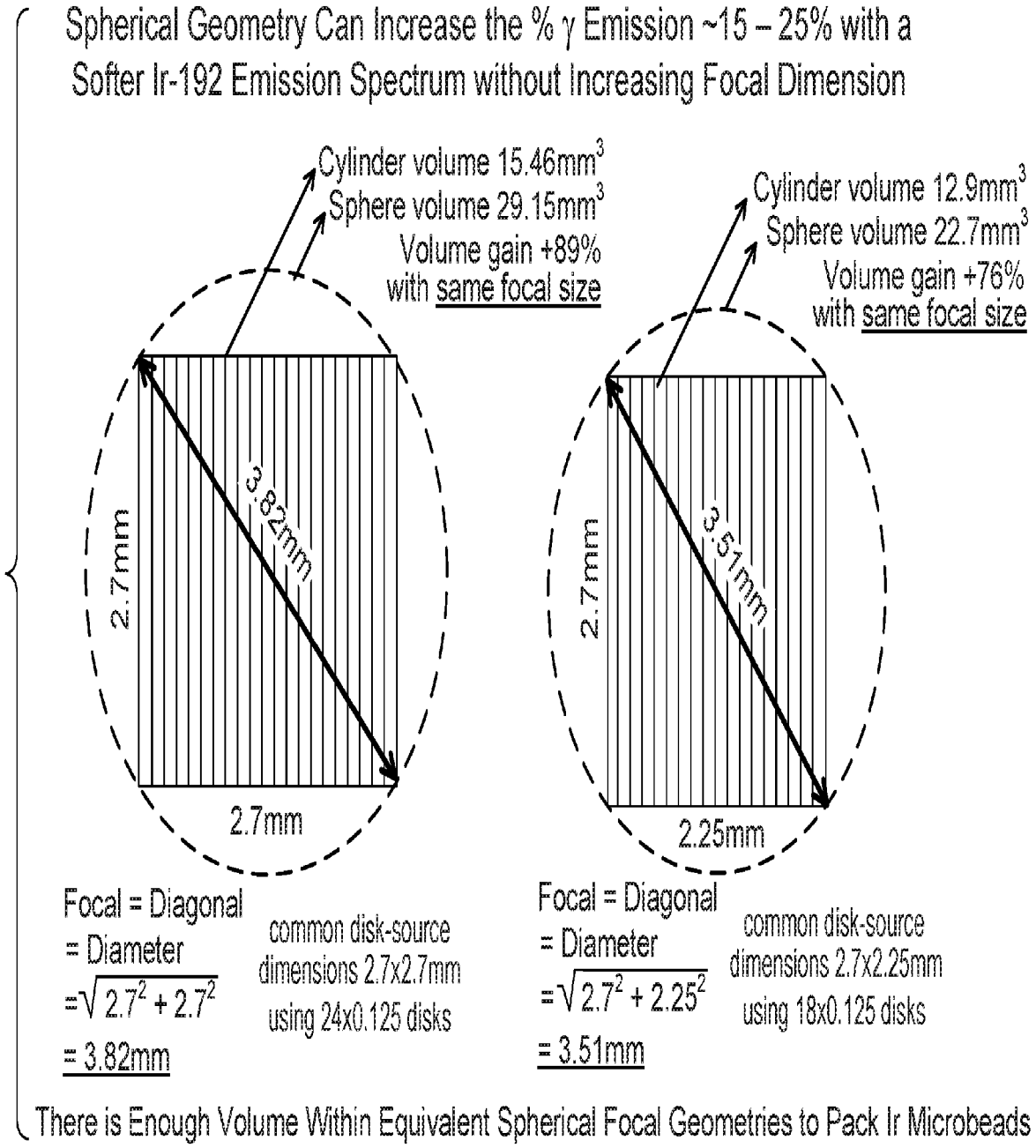
FIG. 3 illustrates the volume ratios of cylindrical stacks vs. spheres having the same focal dimension and the typical increase in emissivity and irradiation yield achieved with an embodiment of the present disclosure.

Similarly, referring to FIG. 3, one sees a typical increase in emissivity and radiation yield compared with prior art 100 percent dense iridium and proportionally higher emission at lower energies. It is noted for example, that a fifty-three percent dense sphere of a given diameter "d" (such as, but not limited to, 3.82 millimeters) has eighty-nine percent more volume than a 100 percent dense right cylinder, with a 3.82 mm. diagonal "d". Such a right cylinder has a height and diameter both equal to 2.7 mm. (3.82 mm. divided by the square-root of 2.0). These dimensions are quite typical of the active-dimensions of standard cylindrical 100 Ci Iridium-192 sources containing natural Iridium-192. However, the referenced sphere or quasi-sphere has the same focal dimension and estimated eleven to seventeen percent higher output than the referenced right cylinder (note that the relative increase in output depends on the direction the emission is measured in: axial, radial, $4\pi$ or other). It is therefore expected that spherical or quasi-spherical low density iridium-192 increases source output efficiency in the approximate range 11-17 percent. With an expected reactor yield increase in the range of 7-11 percent, it is expected that the combined reactor yield plus output efficiency increase will be on the order of 18-28 percent.

Figure 4:
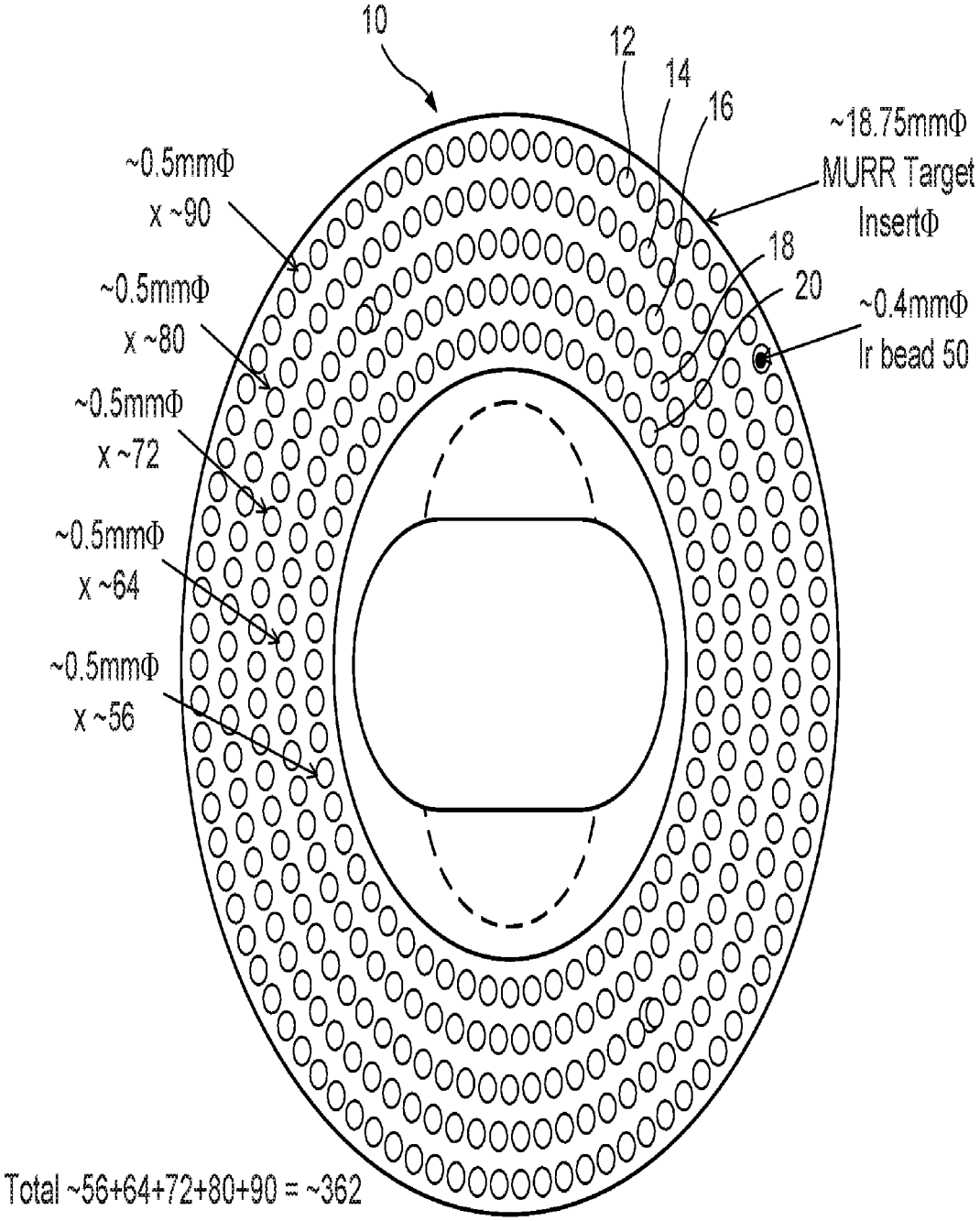
FIG. 4 illustrates a stackable cassette of the present disclosure, encasing 362 iridium beads.
Figure 5:
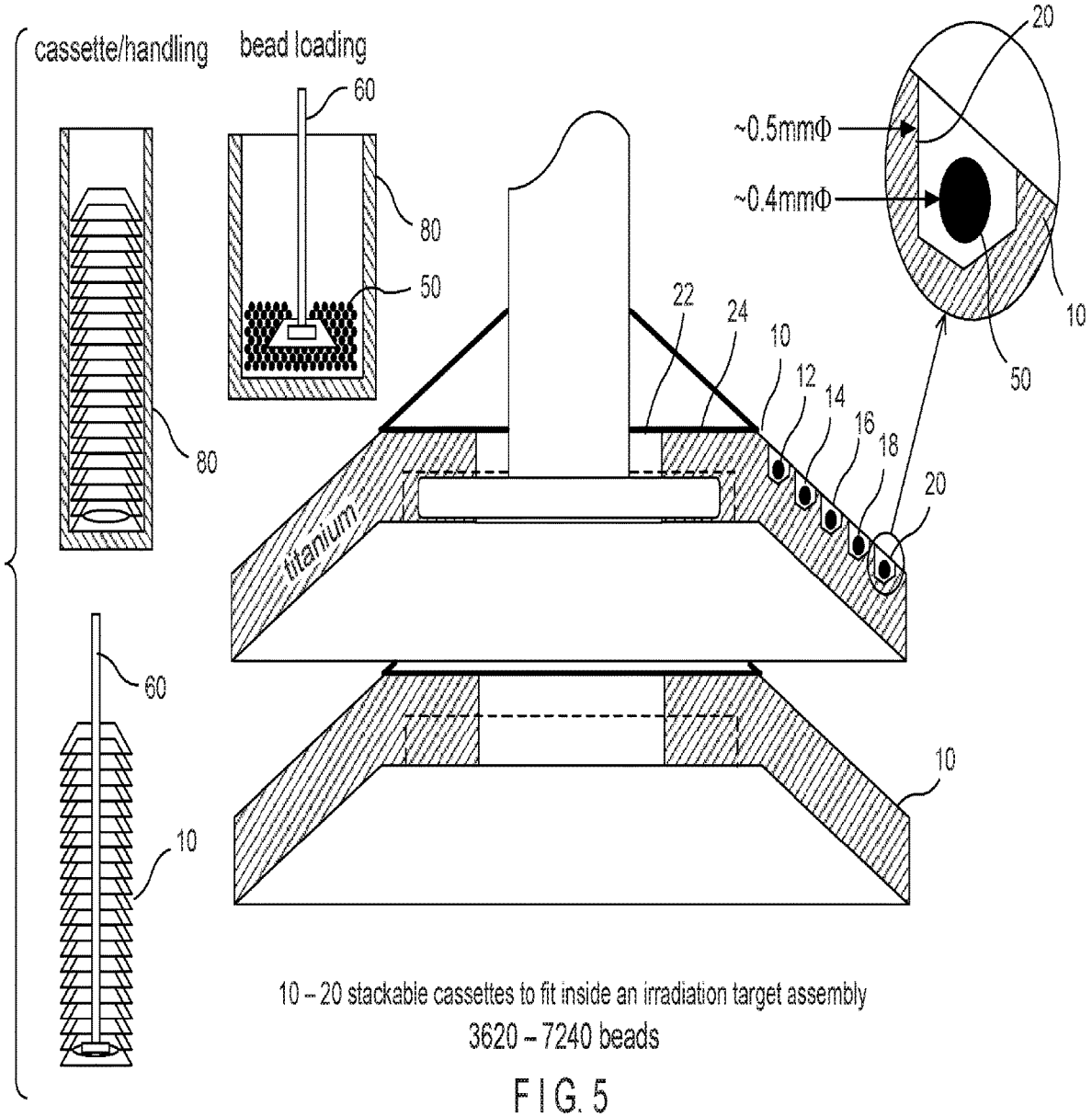
FIG. 5 illustrates an irradiation target assembly of the present disclosure, including a plurality of the stackable cassettes with a plurality of rings of iridium microbeads.

FIG. 4 illustrates a stackable cassette 10, or reactor irradiation target insert (typically made of titanium, but other low-activating metals or materials that are compatible with the reactor core may be used depending upon the application), of the present disclosure, encasing approximately 362 iridium microbeads (typically spherical or quasi-spherical in shape, with an optimal diameter of approximately 0.4 millimeters, or typically within the range of 0.25-0.60 mm., and, in some applications may be replaced with microcylinders) in this example there are five rings 12, 14, 16, 18, 20 (concentric with respect to a rotational axis of cassette 10, when viewed from above such as in FIG. 4, but diagonally offset as viewed from the side in FIG. 5) with channel thickness typically of 0.5 millimeters. In the illustrated embodiment, there are 90 beads in the outermost ring 20, 80 beads in the second outermost ring 18, 72 beads in the third outermost ring 16, 64 microbeads in the second innermost ring 14 and 56 beads in the innermost ring 12. These number of rings and channels and dimensions may vary according to the specific embodiment, reactor core design and application.

FIG. 5 illustrates an irradiation target assembly 80 of the present disclosure, shaped as hollow cylindrical structure, including a plurality of the stackable cassettes 10 of iridium microbeads 50 (which may be spherical, quasi-spherical or cylindrical). In the illustrated embodiment, ten to twenty cassettes 10 may be stacked for a total of 3620-7240 beads 50. The diagonal offsetting of the rings causes a cone shape, thereby providing a nesting type function allowing subsequent cassettes 10 to engage each other while distributing the microbeads within the target assembly so that they don't unduly shield each other from the neutron flux in the reactor core. Additionally, a concentric aperture 22 in the center platform 24 of the cassette 10 allows for engagement by a vertical shaft 60, either during the loading of the microbeads 50 into the cassette 10 or the loading of the cassettes 10 into the irradiation target assembly 80. Again, these numbers may vary according to the specific embodiment and application. Design, dimensions and total mass loading of the target assembly may vary, depending on the choice of reactor and neutron flux used for activations.

Figure 6:
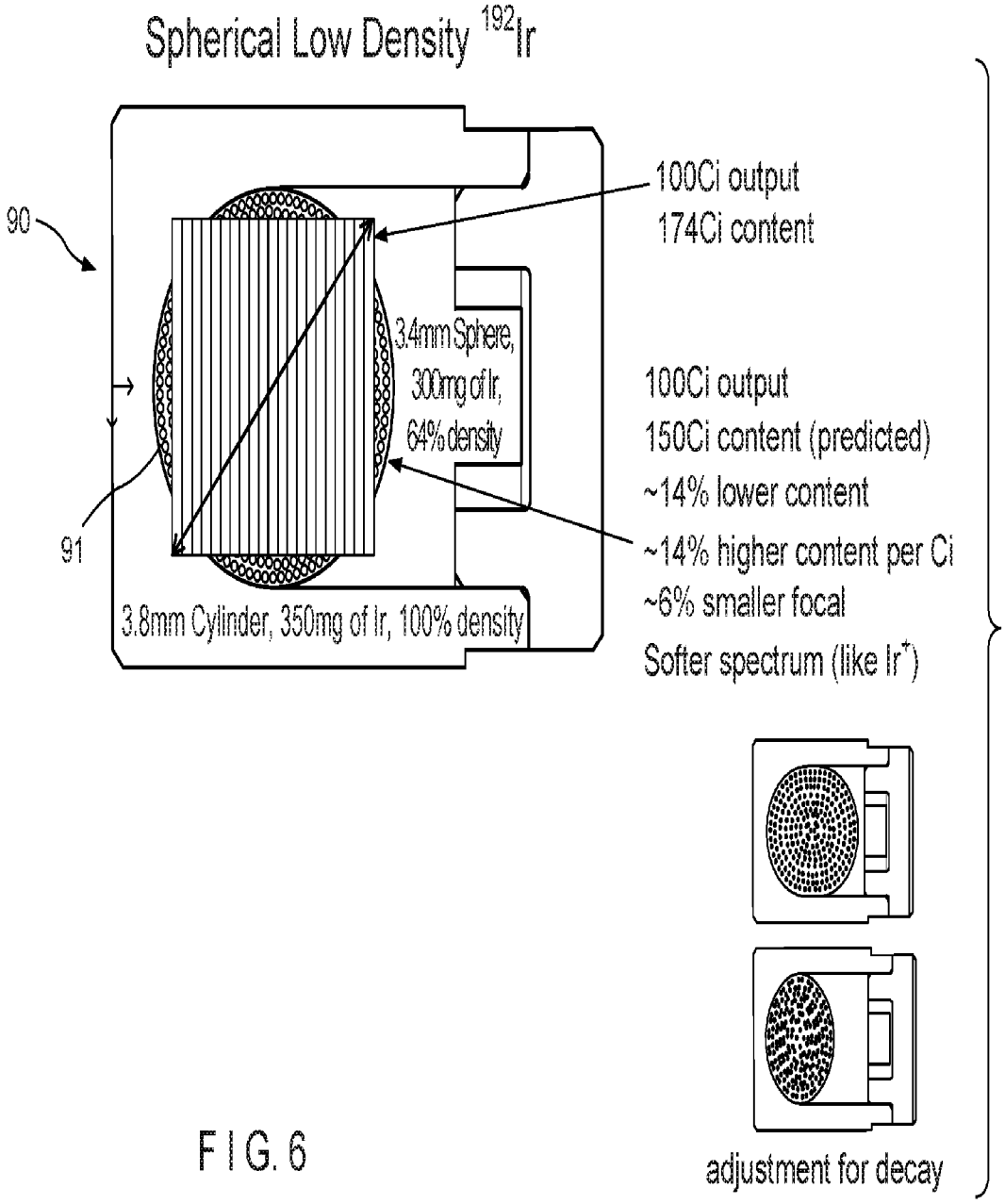
FIG. 6 illustrates a further embodiment of the iridium source of the present disclosure.

FIG. 6 illustrates a further embodiment of the iridium source 90 of the present disclosure. In this embodiment, random-packed (or partly random) microbeads of iridium (or Iridium-192 as a low-density alloy, compound or alloy or composite that is formed into a sphere, quasi-sphere or cylinder) are in a spherical or quasi-spherical source cavity 91, which is illustrated being filled with microgranules, microbeads or microcylinders. Aluminum or other low density inorganic binders may be used to fix the microgranules, microbeads or microcylinders inside the source 90 after activation. This is expected to optimize the yield and output benefits, as well as image contrast and resolution, resulting in higher output efficiency of 11-17 percent. The focal dimension of the spherical or quasi-spherical low density Iridium-192 source, which equals the maximum internal dimension of the cavity, would be no larger than the diagonal of a stacked-disk cylindrical source. The optimum iridium density in the active insert is in the range 30 to 85 percent of the density of 100 percent dense pure iridium. Further optimum density ranges include 40 to 70 percent of the density of 100 percent dense pure iridium and 50 to 65 percent of the density of 100 percent dense pure iridium and 50 to 65.

An alternate embodiment contains Iridium-191 in the form of a metal, alloy, compound, or composite, which is formed into a disk or annulus or other thin flat shape, less than 0.5 mm. thick, prior to neutron irradiation so that it can be activated in conventional activation target canisters and then compressed, compacted, molded or otherwise formed into a sphere or quasi-sphere after activation.

Figure 11:
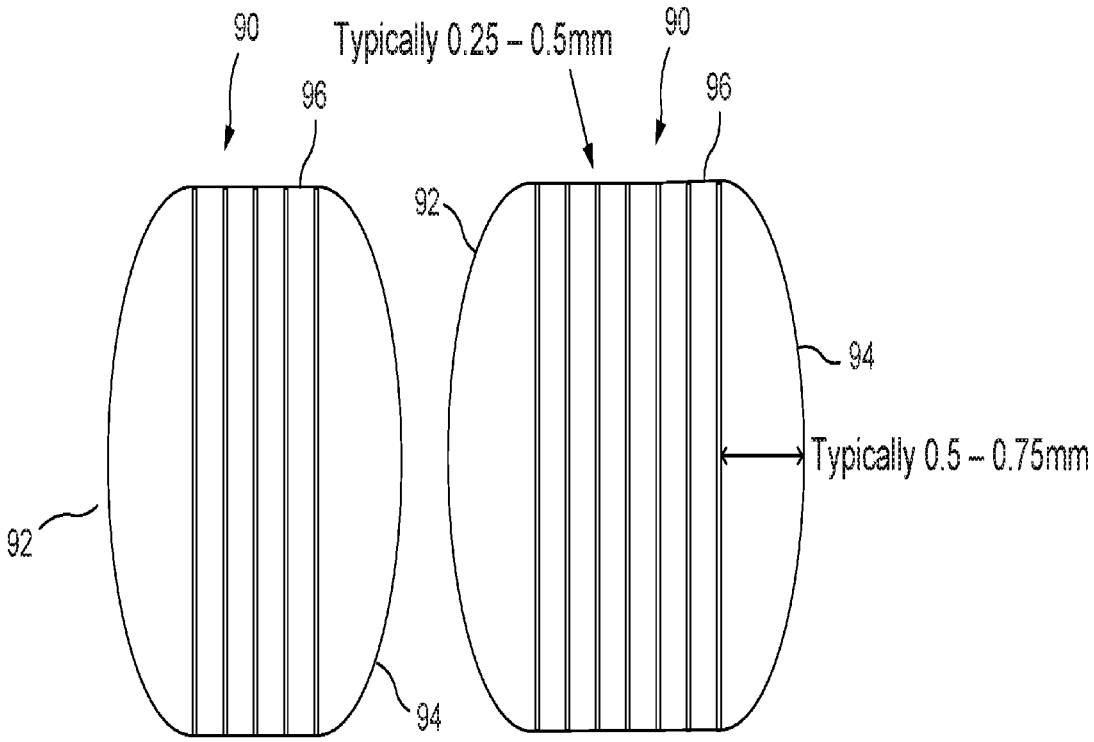
FIG. 11 is a side plan view of a further embodiment of the irradiation source of the present disclosure.

A further alternative embodiment of an irradiation source 90 as shown in FIG. 11 contains Iridium-191 in the form of a metal, alloy, compound, or composite of the above optimum iridium density range of the active insert (chosen from 30-85 percent, 40-70 percent or 50-65 percent) in which hemi-discus-shaped, hemi-ellipsoid or chamfered end-pieces 92, 94 are placed at each end of a stack of flat disks 96. The disks 96 may optimally be approximately be 0.25 mm. thick or up to a maximum of about 0.5 mm. thick to maximize activation efficiency and minimize neutron self-shielding during activation. The curved end pieces 92, 94 may optimally be approximately be 0.5 mm. thick in the center or up to a maximum of about 0.75 mm. thick in the center to maximize activation efficiency and minimize neutron self-shielding during activation. This forms a cylinder with curved (or chamfered) ends (similar to a domed vosoid or shiltoid shape). Though this geometry is less spherical in shape than the preferred shapes, this may have other advantages. It could enable conventional disk irradiations to be carried out using conventional irradiation target geometry.

Figure 8:
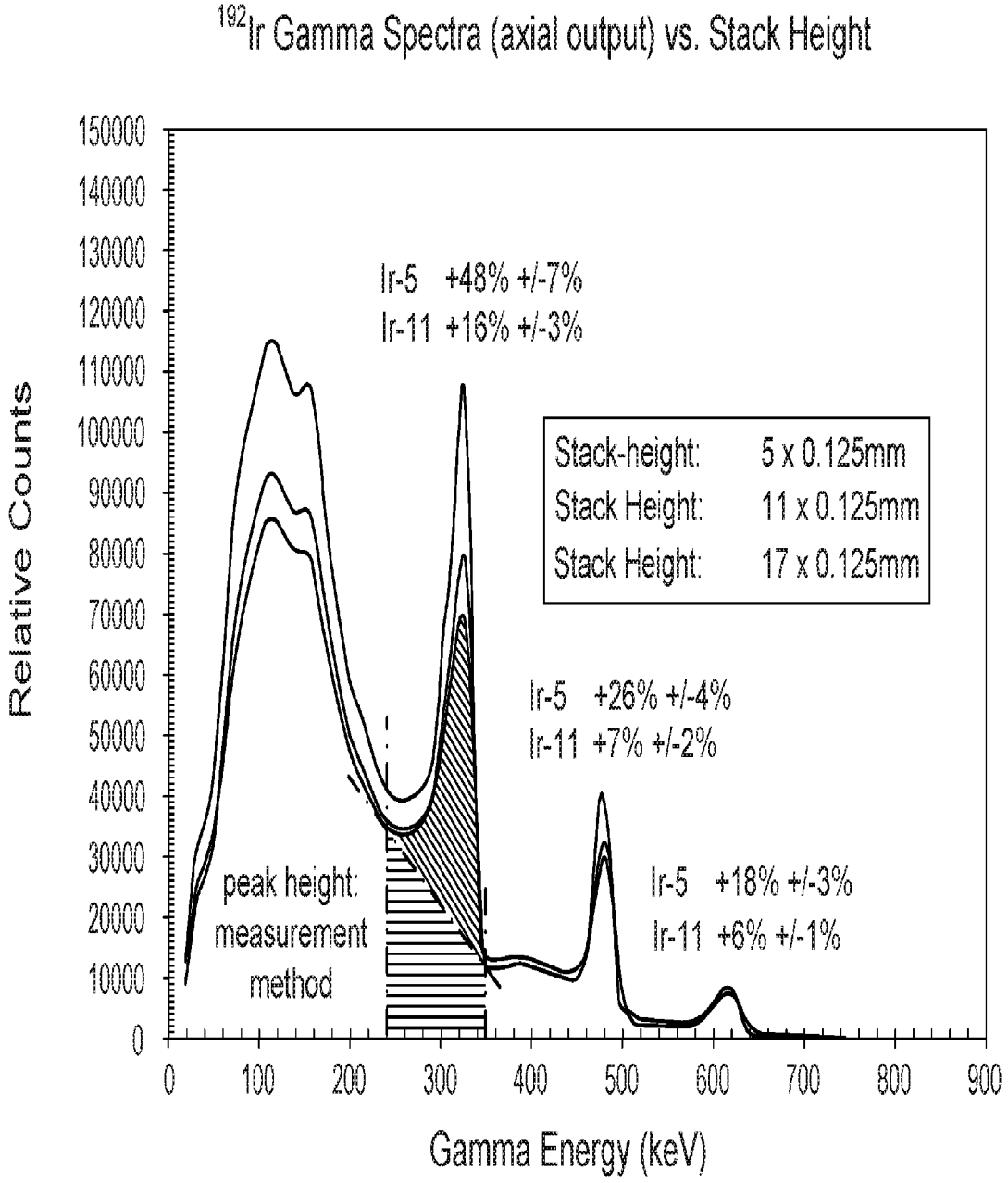
FIG. 8 illustrates the gamma spectra, measured in the axial direction, for radiation sources of different stack heights, thereby simulating different densities (the measured emission abundances are consistent with calculated abundances in FIG. 3).
Figure 9:
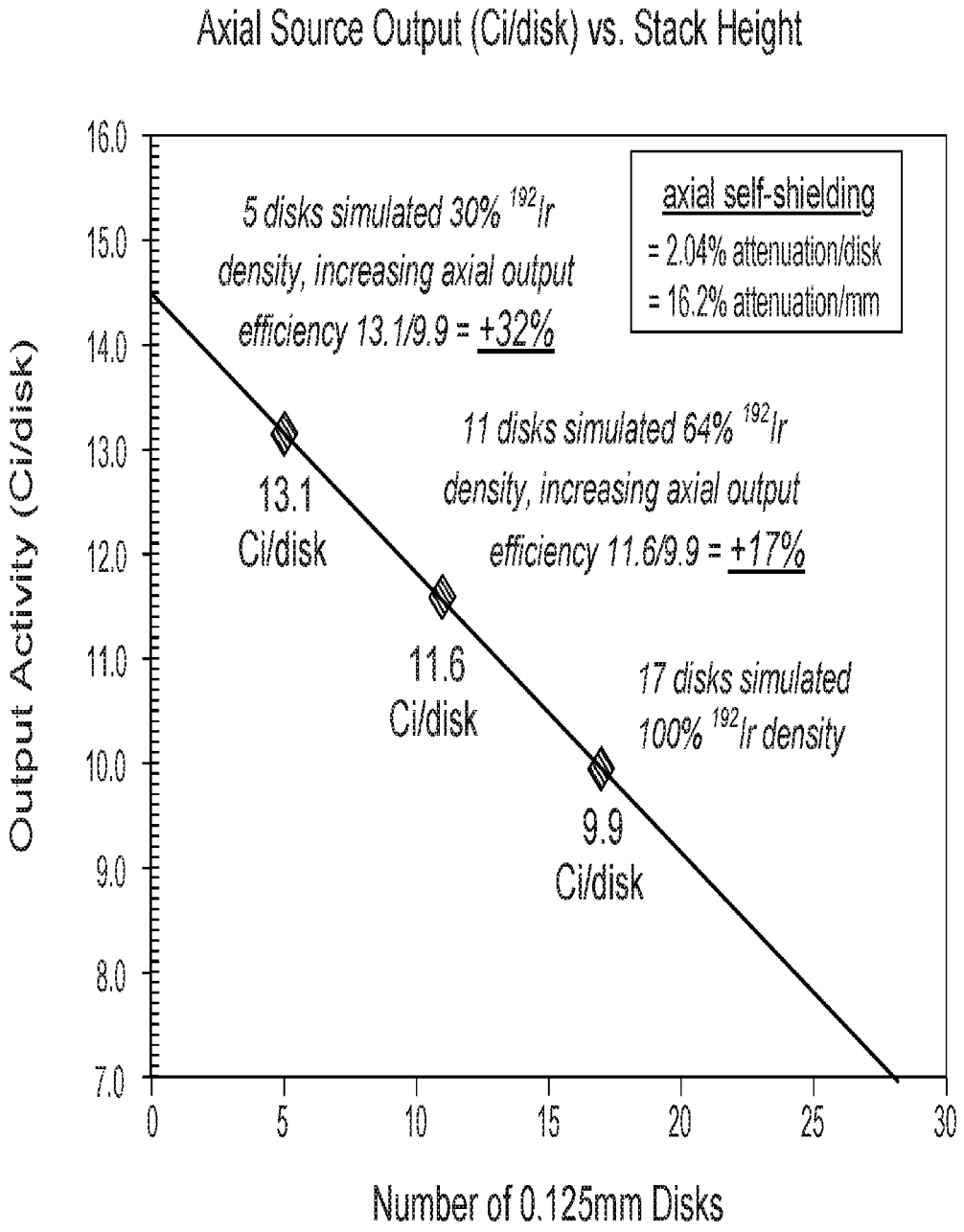
FIG. 9 illustrates axial source output versus stack height, thereby simulating different source densities.
Figure 10:
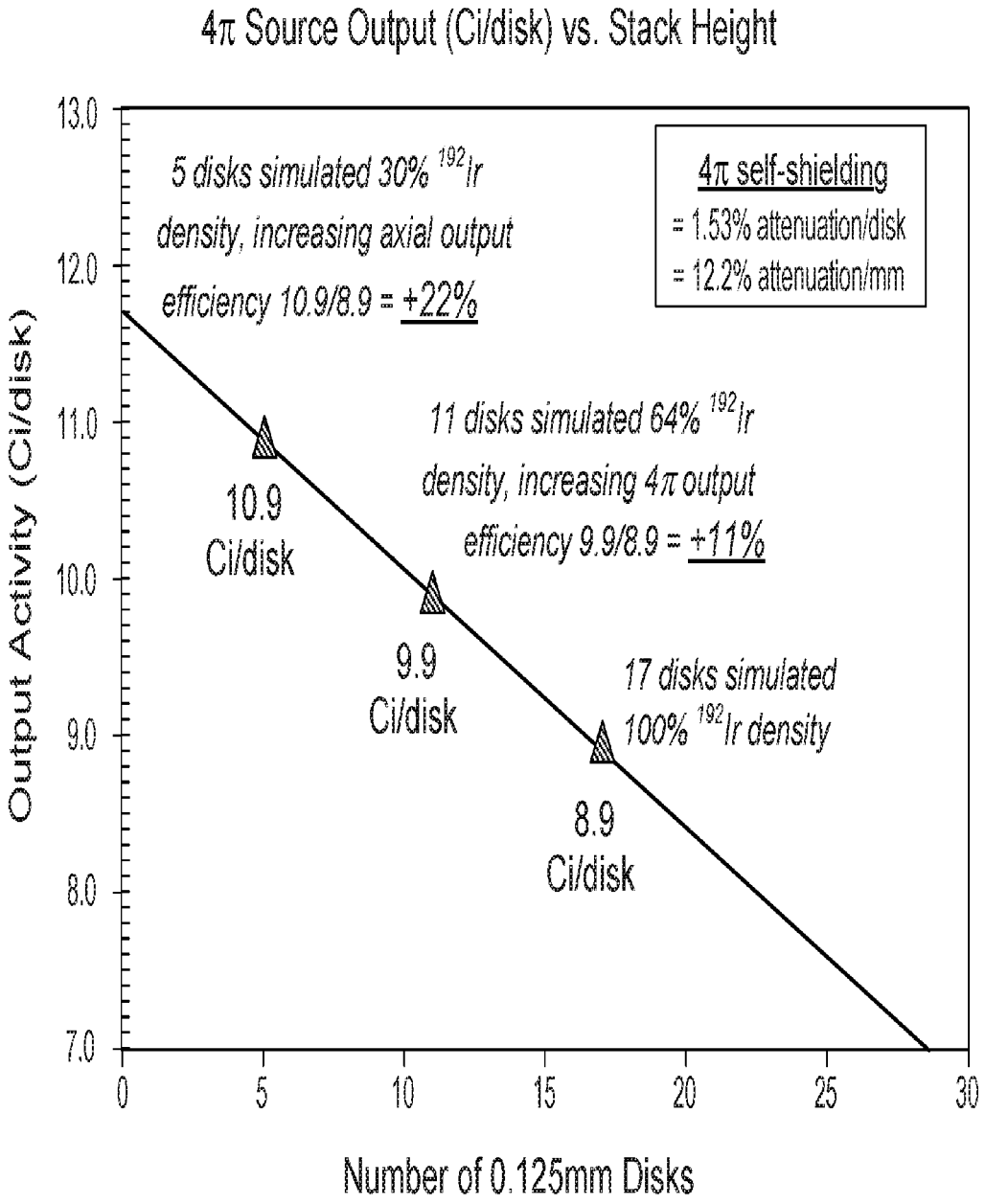
FIG. 10 illustrates spherical or $4\pi$ output versus stack height, thereby simulating different source densities.

FIGS. 8-10 illustrate the tests wherein different numbers of disks were used to simulate emission from 30 percent, 64 percent and 100 percent dense iridium. That is, tests were performed with 5, 11 and 17 stacked disks, respectively, wherein the disks were 0.125 mm. in thickness.

It is to be expected that lower density iridium would emit substantially high abundance gamma rays at the low-energy end of the emission spectrum. FIG. 8 illustrates the gamma spectra taken in the axial direction from the three sources (5, 11 and 17 disks). FIG. 8 confirms that the five-disk source, simulating the internal self-absorption of thirty percent theoretical density (relative to pure, standard focal, solid iridium source geometry), shown in the highest of three graph lines, emitted 48 percent higher abundance at 288-316 keV, 26 percent higher at 468 keV and 18 percent higher at 589-612 KeV, as compared to the seventeen-disk source (illustrated in the lowest of the three graph lines). Similarly, the eleven-disk source, simulating 64 percent density, shown in the middle of the three graph lines, emitted 18 percent higher abundance at 288-361 keV, 7 percent higher at 468 keV and 6 percent higher at 589-621 keV.

Relative emission abundance was determined by measuring the area under each photo-peak. This was done conventionally by summing the counts under each peak and subtracting the wedge-shaped area under the tangential baseline of each peak.

The softer spectrum of the spherical low density Iridium-192 was expected to improve image quality of radiographs relative to conventional iridium sources. It is known that, for example, the lower energy spectrum of Selenium-75 significantly improves image quality relative to iridium-192 when radiographing substrates with thickness below 40 mm. of steel. The results of a conventional penetrometer test were that the five-disk source (simulating 30 percent density) typically resolved features 4 percent smaller on average than the 17-disk source (simulating 100 percent density) and that the eleven-disk source typically resolved feature 1.5 percent smaller on average than the 17-disk source (simulating 100 percent density).

Measurements of axial dose rates were taken for the five, eleven and seventeen-disk configurations described above. The output activity per disk was plotted against the number of disks in the configuration. As shown in FIG. 9, the seventeen-disk configuration had an axial output of 9.9 curies per disk, while the eleven and five-disk configurations had an axial output of 11.6 and 13.1 curies per disk, respectively.

The steep slope of the graph of FIG. 9 indicates that the output-per disk of the sources (i.e., output efficiency) measured in the axial direction increased significantly when the stack height was reduced from 17 disks to 11 disk and 5 disks, simulating 64 percent density and 30 percent density, respectively. This confirms that reducing stack height, and therefore reducing density, significantly increased output efficiency. The axial output per disk of the five-disk and eleven disk source increased by 32 percent and 17 percent, respectively, with respect to the seventeen-disk (i.e., 100 percent density). The slope of FIG. 9 indicates that the axial self-shielding is approximately 2.03 percent per disk, the equivalent of 16.2 percent per millimeter of iridium.

Similar measurements were made with respect to $4\pi$ (spherical) output (Curies per disk) versus stack height and graphed on FIG. 10. The $4\pi$-output-per-disk of the five and eleven-disk sources increased 22 percent and 11 percent, respectively, with respect to the seventeen-disk source. The slope of the graph of FIG. 10 indicates that the axial self-shielding (with respect to $4\pi$ output) is approximately 1.53 percent per disk, or 12.2 percent per millimeter of iridium.

A change in stack height from 17 disks to 11 disks results in a 35.3 percent reduction in total mass of iridium. This was found to reduce the total net output by 24.3 percent while increasing the efficiency by 17 percent. Therefore, a similar 35.3 percent reduction in source density would likewise be expected to result in a 24.3 percent reduction in output Curies.

Therefore, low density source inserts with the same physical volume and lower mass have higher output efficiencies. However, while it follows that low-density source inserts with the same total mass of iridium and correspondingly larger volumes would have higher efficiencies, it would typically be necessary to change from a cylindrical to a spherical or quasi-spherical geometry to avoid increasing the focal dimension. As shown in FIG. 3, a sphere having the same focal diameter as the diagonal of a right-cylinder has 89 percent more volume. Such a sphere would therefore have equal mass to a cylinder if it was 53 percent dense. Such a density is in the middle of the practical range for random or partly random packing of iridium microbeads or for low-density iridium alloys, compounds or composites with low density metals or ceramics.

It can be derived that such a spherical or quasi-spherical low-density Iridium-192 source would have seventeen percent less mass and activity, but equivalent output, to a conventional one hundred percent dense 2.7 mm. by 2.7 mm. solid disk (cylindrical) source. Such a spherical or quasi-spherical low-density Iridium-192 source would be expected to have a reduced raw material (Iridium-192) requirement while maintaining the source output activity. Further, image quality would be expected to improve by two percent due to a softer gamma ray spectrum while the typically five percent smaller focal dimension (such as 3.63 mm. as compared to 3.82 mm.) would either improve image quality or enable shot time to be reduced by ten percent by moving sources five percent closer to an object being radiographed.

In addition to the expected eleven to seventeen percent output efficiency gain, it is further expected that there would be an additional activation yield gain if the spherical or quasi-spherical low-density Iridium-192 has reduced neutron self-shielding during irradiation. An apparent gain of 15-27 percent for a density range of 50-65 percent was measured when annular disks were irradiated, which is similar to the predicted 18-28% gain expected using spherical or quasi-spherical low-density Iridium-192.

Self-attenuation of gamma rays within cylindrical Iridium-192 sources depends upon on the diameter of the disk stack, the disk height and the electron-density of disks in a source. Iridium is extremely dense (22.42 grams per cubic centimeter) and has one of the highest electron-densities of all elements in the periodic table and therefore a very high rate of attenuation due to self-shielding. Iridium has a "first half thickness" of 1.42 millimeters. That is, an iridium thickness of 1.42 millimeters results in an attenuation of its own gamma rays of fifty percent.

To calculate self-shielding of a "shape", the "effective thickness" must be known. The "effective thickness," for purposes of calculating self-attenuation, is typically half of the actual (or average) thickness in the direction of the emission. Some typical examples are that a cylinder, with respect to the axial direction, has an effective thickness of 0.5 times the stack height; a cylinder, with respect to the radial direction, has an effective thickness of 0.3927 times the diameter; a cylinder (with diameter d and height h), with respect to an angle $\theta$ measured with respect to the circular top has an effective thickness of $\pi dh/2(\pi d \sin\theta + 4h \cos\theta)$. Similarly, the average spherical ($4\pi$) self-shielding of a right cylinder would be $dh/(d+2h)$.

Using these values for shielding thickness, the relative output of any iridium source at any angle of emission could be estimated using 1.42 mm. as the half-thickness of Iridium-192 gamma rays in iridium.

It is further noted that the calculations are approximate because half-thickness is not a constant but varies slightly with the thickness of the shielding, as subsequent half-thickness values increase as the Iridium-192 spectrum hardens when it passes through matter. However, these calculations provide valid trends in self-shielding as a function of density, shape and direction of emission and they add more certainty to uncertain measured data, which can be prone to systematic error and calibration uncertainly.

A sphere having the same mass (347 mg) and focal dimension (3.82 mm.) as a 2.7 by 2.7 mm. right cylinder of iridium was calculated to have a 53.03 percent density. This would be typical of the density of random or partly random packed microbeads in a spherical source cavity.

The output of this sphere was calculated (not including capsule wall effects) to be:

1. 24 percent higher than the axial output of a 2.7 mm. by 2.7 mm. right cylinder;

2. 13 percent higher than the radial output of a 2.7 mm. by 2.7 mm. right cylinder;

3. 8 percent higher than the spherical ($4\pi$) output of a 2.7 mm. by 2.7 mm. right cylinder; and 4. 6-8 percent lower than the output of a 2.7 mm. by 2.7 mm. right cylinder at a 30 to 60 degree tilt angle (the most efficient emission direction of a right cylinder because its average thickness is thinnest when facing in this direction).

The output of spherical sources should be isotropic (the same in all directions) if attenuation effects in capsule walls are ignored. However, the output of cylindrical sources depends on the emission direction. Typically, short stacks (less than seventeen 0.125 mm. disks) emit higher axially than radially while tall stacks (greater than seventeen 0.125 mm. disks) emit higher radially than axially. At intermediate angles (30-60 degrees), calculations confirm that cylindrical sources, except for very short stacks, have higher emissions at these angles than either axially or radially.

Therefore, from both the calculated and measured data, it is expected the spherical low-density Iridium-192 would increase source output efficiency in the range of eleven to seventeen percent at practical emission angles commonly used by radiographers. Radially is the most direction most commonly or typically used by radiographers. However, a single value cannot be specified for the expected source output efficiency increase because, in practice, this is expected to vary depending upon the effective density and thickness of the active insert in the direction and geometry of measurement.

Furthermore, analysis of the gamma spectra showed that spherical low density Iridium-192 would emit greater than twenty percent higher abundance gamma rays in the region of lower-energy 288-316 keV photo-peaks relative to 100 percent dense iridium, resulting in two percent improved image quality (i.e. low-density iridium was found in tests to resolve 2% smaller features relative to 100% dense iridium).

Thus the several aforementioned objects and advantages are most effectively attained. Although preferred embodiments of the invention have been disclosed and described in detail herein, it should be understood that this invention is in no sense limited thereby.

What is claimed is:

1. A radiation source including iridium wherein the density of the active insert containing the iridium is in a range of 30 to 85 percent of the density of 100% dense pure iridium.

2. The radiation source of claim 1 wherein the iridium is in a range of 40 to 70 percent of the density of 100% dense pure iridium.

3. The radiation source of claim 1 wherein the iridium is in a range of 50 to 65 percent of the density of 100% dense pure iridium.

4. The radiation source of claim 1 wherein the iridium is in the form of microbeads containing Iridium-192.

5. The radiation source of claim 4 wherein the microbeads of Iridium-192 are in a random or partly random packed configuration.

6. The radiation source of claim 1 wherein the iridium is Iridium-192 contained within and metal, alloy, compound, or composite and formed into a sphere or quasi-sphere.

7. The radiation source of claim 6 wherein the Iridium-192 is contained within a metal, alloy, compound, or composite material and formed or shaped by a capsule cavity into a sphere or quasi-sphere by a method of physical compression or compaction.

8. The radiation source of claim 1 wherein the iridium is in the form of approximately 0.4 mm. diameter microbeads or approximately 0.3 mm diameter microcylinders containing Iridium-191, prior to neutron irradiation.

9. The radiation source of claim 8 wherein the microbeads or microcylinders of Iridium-191 are in a random-packed or partly random configuration.

10. The radiation source of claim 1 wherein the iridium is in the form of microbeads with a diameter of 0.25-0.60 mm. or microcylinders with a diameter of 0.20-0.50 mm, containing Iridium-191, prior to neutron irradiation.

11. The radiation source of claim 1 wherein the iridium is in the form of approximately 0.3 mm diameter wire containing Iridium-191, prior to neutron irradiation, which is then cut after activation to form microcylinders.

12. The radiation source of claim 1 wherein the iridium contains Iridium-191 in the form of a metal, alloy, compound or composite, prior to neutron irradiation.

13. The radiation source of claim 1 wherein the iridium contains Iridium-191 in the form of a metal, alloy, compound or composite, which is formed into a disk, hemi-ellipsoid or other thin flat shape less than 0.75 mm. thick, prior to neutron irradiation so that it can be activated in conventional activation target canisters and formed into a sphere or quasi-sphere after activation.

14. The radiation source of claim 1 further including a spherical or quasi-spherical source cavity in which the iridium is contained.

15. The radiation source of claim 1 wherein the radiation source is comprised of a plurality of disks of iridium in the form of a metal, alloy, compound or composite.

16. An activation target insert formed in a disk-shape and including a plurality of microbeads or microcylinders of iridium.

17. The activation target insert of claim 16 wherein the microbeads are spherical or quasi-spherical in shape or formed as microcylinders.

18. The activation target insert of claim 17 wherein the radiation target insert includes a plurality of at least partially concentric rings which hold the microbeads.

19. The activation target insert of claim 18 wherein the plurality of rings are concentric with respect to a rotational axis of the radiation target insert and are diagonally offset with respect to a direction perpendicular from the rotational axis.

20. The activation target insert of claim 19 further including cone-shaped walls.

21. The activation target insert of claim 20 wherein the cone-shaped walls of successive radiation target inserts nest with each other.

22. The activation target insert of claim 16 wherein the microbeads have a diameter of approximately 0.4 mm or the microcylinders have a diameter of approximately 0.3 mm.

23. The activation target insert of claim 16 wherein the iridium is in the form of microbeads with a diameter of 0.25-0.60 mm. or microcylinders with a diameter of 0.20-0.50 mm.

24. The activation target insert of claim 16 wherein the iridium includes Iridium-192.

25. The activation target insert of claim 16 wherein the iridium includes Iridium-191 and is activated by neutron irradiation.

* * * * *